US011690422B1

(12) United States Patent
Chope et al.

(10) Patent No.: US 11,690,422 B1
(45) Date of Patent: Jul. 4, 2023

(54) GARMENT ASSEMBLY SYSTEM

(71) Applicant: CreateMe Technologies LLC, New York, NY (US)

(72) Inventors: Nicholas Chope, Portland, OR (US); Gaston MacMillan, El Cerrito, CA (US)

(73) Assignee: CreateMe Technologies LLC, New York, NY (US)

( * ) Notice: Subject to any disclaimer, the term of this patent is extended or adjusted under 35 U.S.C. 154(b) by 0 days.

(21) Appl. No.: 17/711,347

(22) Filed: Apr. 1, 2022

(51) Int. Cl.
*A41H 5/02* (2006.01)

(52) U.S. Cl.
CPC ..... *A41H 5/02* (2013.01)

(58) Field of Classification Search
CPC ..... A41H 5/02; A41H 43/02; D05B 39/00; D05B 33/00
See application file for complete search history.

(56) References Cited

U.S. PATENT DOCUMENTS 3,681,785 A * 8/1972 Truman ..... A41H 42/00 2/243.1
4,604,152 A * 8/1986 Liukko ..... B29C 66/729 428/57
4,957,054 A * 9/1990 Sakuma ..... A41H 42/00 112/63
5,406,900 A * 4/1995 Schramayr ..... D05B 33/00 112/475.04
5,419,268 A * 5/1995 Fyler ..... D05B 23/00 112/470.14
5,555,833 A * 9/1996 Schramayr ..... D05B 33/00 112/470.31
5,568,779 A * 10/1996 Wong ..... A41D 27/24 2/125
11,268,223 B1 * 3/2022 Baker ..... D05B 35/102
2013/0048219 A1 * 2/2013 Ferreiro ..... D06H 5/00 156/513
2019/0242044 A1 * 8/2019 Tallmadge ..... D05B 19/16

OTHER PUBLICATIONS

Armhole. Armhole—an overview | ScienceDirect Topics. (n.d.). Retrieved Apr. 13, 2022, from https://www.sciencedirect.com/topics/engineering/armhole.

* cited by examiner

*Primary Examiner* — Nathan E Durham

(57) ABSTRACT

A garment assembly system including a fixture including an opening, an abutment surface formed in either the fixture or a housing disposable on the fixture, and a carrier. The carrier is disposable in the opening. The carrier is moveable between a retracted position and an extended position. In the extended position, the carrier is configured to press an open first joint of a tubular component disposed on the carrier and an open second joint of a base component disposed on the fixture together against the abutment surface.

14 Claims, 14 Drawing Sheets

500

GARMENT ASSEMBLY SYSTEM

BACKGROUND

Despite technological advances and introduction of automation in many types of manufacturing, garment manufacturing remains very labor intensive. Sewing machines were invented in the early nineteenth century and were made possible based on the development of the lock stitch sewing technique. Today, some hundred fifty years later, this same technology remains the foundation of garment manufacturing. The modern process of producing large quantities of ready-to-wear apparels relies heavily on manual labor and remains inefficient relative to other industrial manufacturing processes. Garment manufacturing includes multiple steps including sizing, folding, fitting, cutting, sewing, material handling. The type of tasks needed dictates the level of skilled labor that is required to perform the work. The unique and varied properties of fabric such as weight, thickness, strength, stretchiness and draping as well as the complicated nature of tasks required in apparel manufacturing complicates material handling and automated garment manufacturing.

The conventional process to form a garment with a tubular component (e.g., sleeves, collars, pant legs) is time consuming and labor intensive. For example, the conventional process for assembling a shirt requires attaching each sleeve to a shirt body manually. Only one sleeve is sewn to the shirt body at a time. Each sleeve is manually positioned in a joint (e.g., armhole) of the shirt body. Sleeves are manually sewn onto the shirt body by hand stitching or by manually feeding each sleeve and the shirt body through a sewing machine. Pins may be inserted into the fabric to maintain the position of the sleeve in the joint prior to stitching the seam. The pins are removed once the seam is stitched. Thus, the conventional process to attach sleeves to a shirt requires a trained worker with sufficient hand-eye coordination to form the stitched seam by hand or by sewing machine.

Despite advances in technology, machines still struggle with performing certain tasks that are easily handled by a trained worker with average hand-eye coordination skills. This is one reason the garment manufacturing industry is in a constant search for cheaper human labor rather than investing in advanced automated manufacturing systems. To increase production, a factory may add additional production lines in parallel, which does little to improve efficiency. Even in large factories, most work is performed in piecemeal fashion, with limited coordination between various stations/steps, and movement of material between each station requires a great deal of manual product handling.

Accordingly, there is a need for an automated system for manufacturing garments to increase efficiency and reduce reliance on manual labor.

SUMMARY

In one embodiment, a method of assembling a garment, includes placing a base component with a first joint on a fixture, the fixture maintaining a three-dimensional shape of the base component to hold the first joint at least partially open, the first joint including a first seam portion. The method further includes placing a tubular component with a second joint on a carrier, the second joint including a second seam portion. The method further includes applying an adhesive to the first seam portion or the second seam portion, or both the first seam portion and the second seam portion. The method further includes mating the first seam portion disposed on the fixture and the second seam portion disposed on the carrier and placing the adhesive in contact with both the base component and the tubular component to form a seam.

In one embodiment, a garment assembly system includes a fixture including an opening, an abutment surface formed in either the fixture or a housing disposable on the fixture, and a carrier. The carrier is disposable in the opening. The carrier is moveable between a retracted position and an extended position. In the extended position, the carrier is configured to press an open first joint of a tubular component disposed on the carrier and an open second joint of a base component disposed on the fixture together against the abutment surface.

In one embodiment, a method of assembling a shirt includes disposing a shirt body on a fixture, wherein the shirt body includes a first shoulder joint and a second shoulder joint held at least partially open by the fixture. The method further includes placing a first sleeve on a first carrier, the first sleeve including a first sleeve joint held at least partially open by the first carrier. The method further includes placing a second sleeve on a second carrier, the first sleeve including a second sleeve joint held at least partially open by the first carrier. The method further includes inserting the open first sleeve joint of the first sleeve disposed on the first carrier into the open first shoulder joint, at least one or both of the first sleeve joint and the first shoulder joint having adhesive disposed thereon. The method further includes inserting the open first sleeve joint of the second sleeve disposed on the second carrier into the open second shoulder joint, at least one or both of the second sleeve joint and the second shoulder joint having adhesive disposed thereon. The method further includes pressing the open first shoulder joint and the open first sleeve joint together against a first abutment surface such that the adhesive forms a first seam. The method further includes pressing the open second shoulder joint and the open second sleeve joint together against a second abutment surface such that the adhesive forms a second seam.

BRIEF DESCRIPTION OF THE DRAWINGS

So that the manner in which the above recited aspects are attained and can be understood in detail, a more particular description of embodiments described herein, briefly summarized above, may be had by reference to the appended drawings.

It is to be noted, however, that the appended drawings illustrate typical embodiments and are therefore not to be considered limiting; other equally effective embodiments are contemplated.

DETAILED DESCRIPTION

The conventional process to assemble a garment from a base component and one or more tubular components requires manually sewing each tubular component to the base component one at a time. For example, a first sleeve of a shirt is sewn to a shirt body before a second sleeve is sewn to the shirt body. Unlike the conventional process, a garment assembly system is described herein that facilitates joining one or more tubular components to the base component with reduced or eliminated manual handling of the garment components. Although the primary example depicted and described herein are sleeves being attached to a shirt, dress, or jacket body, the techniques described herein are equally applicable for the fabrication of attaching pant legs to a pant body, collars to a shirt, dress, or jacket body, or other tubular garment component to another garment component.

Figure 1A:
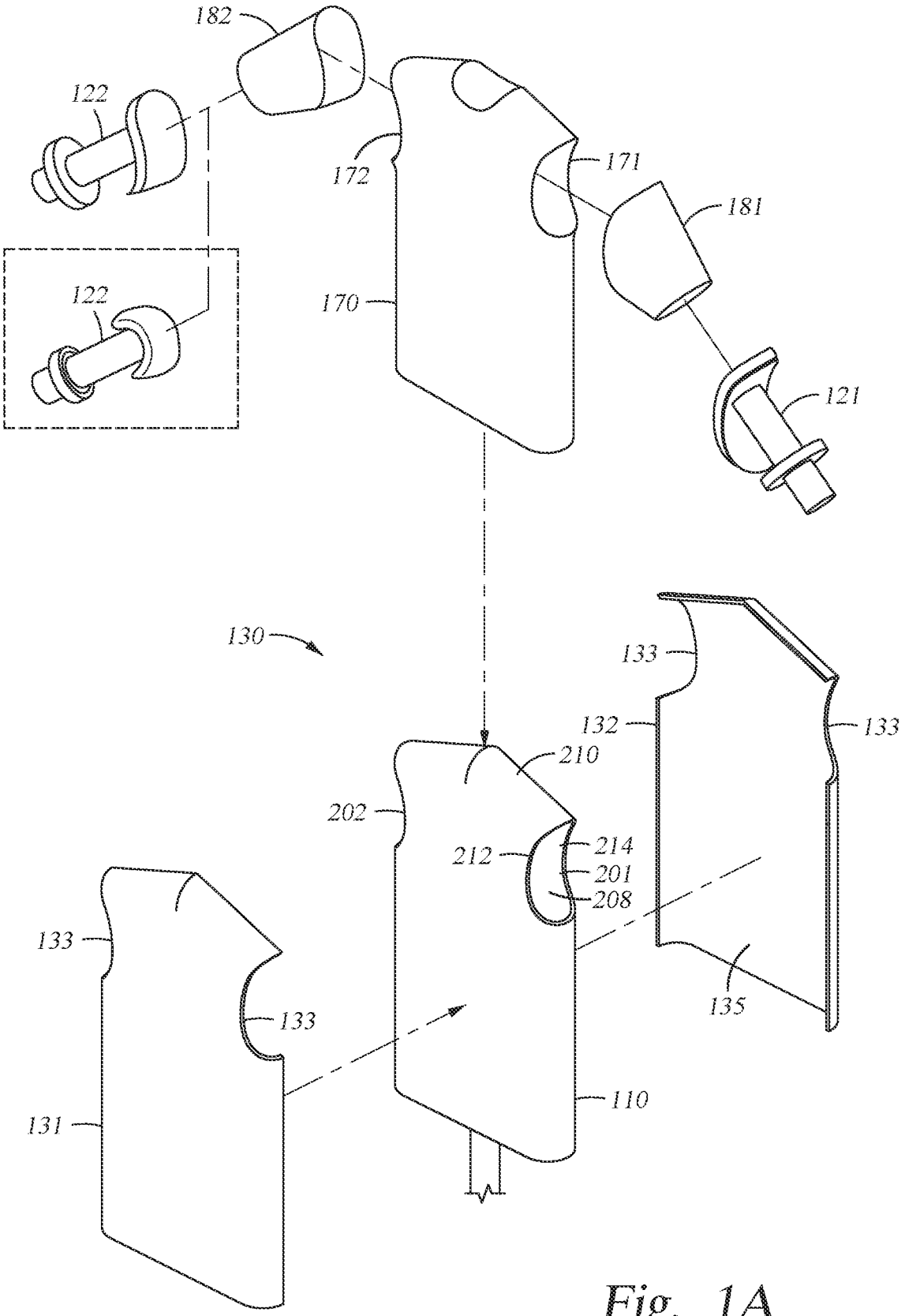
FIG. 1A is a schematic illustration of a garment assembly system.
Figure 1B:
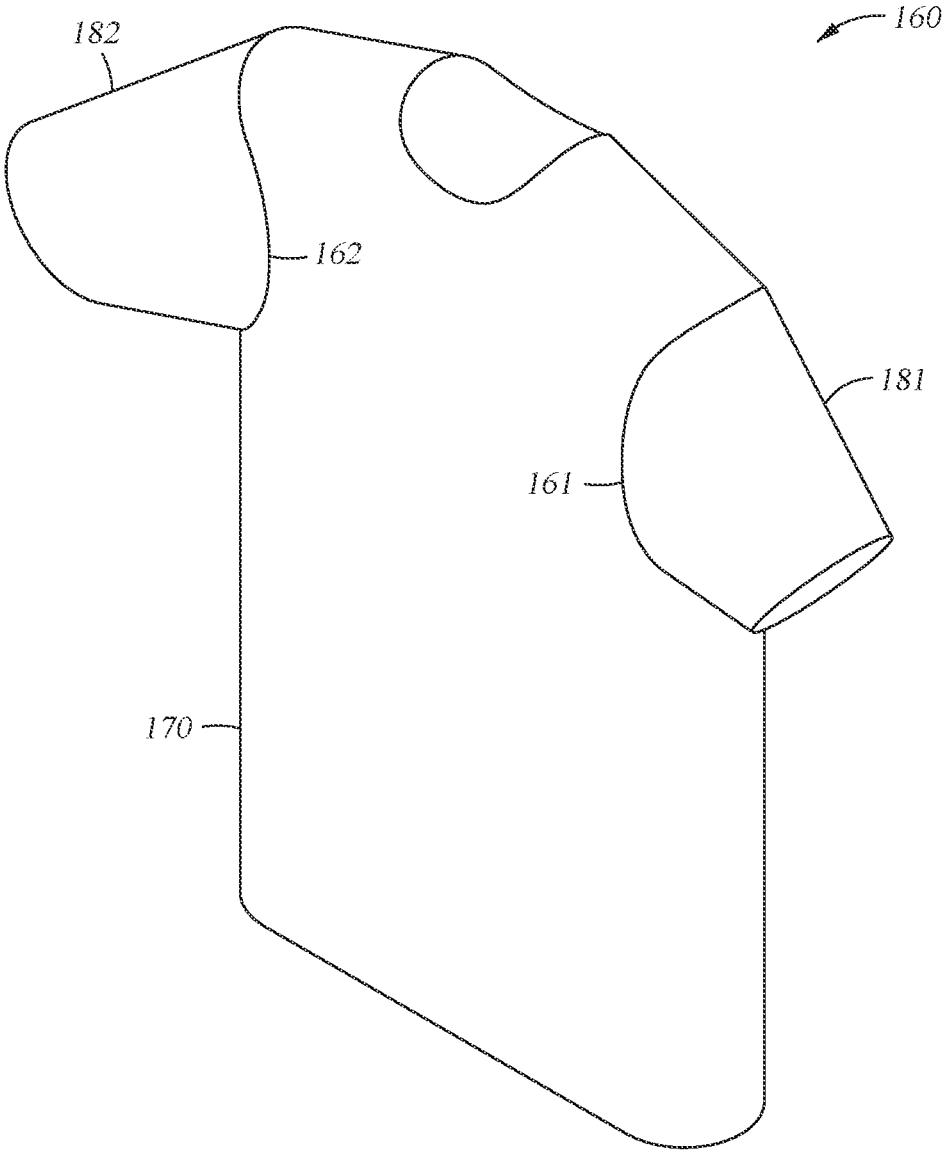
FIG. 1B is an example of a garment that may be assembled using the system depicted in FIG. 1A.

FIG. 1A illustrates a schematic illustration of a garment assembly system 100 to form a garment 160 shown in FIG. 1B. The garment assembly system 100 includes a fixture 110, a first carrier 121, and a second carrier 122. The garment system 100 may optionally include a housing 130. The garment 160 includes a base component 170, and at least one tubular component. In FIGS. 1A-1B, the garment 160 is depicted as a t-shirt, where the at least one tubular component is a first tubular component 181 and a second tubular component 182. As such, the base component 170 is depicted as a t-shirt body, and the tubular components 180, 181 are depicted as sleeves. Assembling the garment 160 includes joining the first tubular component 181 to the base component 170 with an adhesive to form a first seam 161 and joining the second tubular component 182 to the base component 170 with an adhesive to form a second seam 162.

FIG. 1A illustrates the optional housing 130 in an open position. The housing is moved to a closed position to enclose the fixture 110 and base component 170 therein. In one example, the housing 130 is configured as a clamshell which includes a front piece 132 and back piece 134. The front and back piece 132, 134 are moveable relative to one another to open and close the housing 130. In some embodiments, a hinge connects the front piece 132 and the back piece 134. The front piece 131 and back piece 132 may each have a profile 133 that forms an opening adjacent to the opening in the fixture 110 when the housing 130 is in the closed position. The front piece 132 has an inner surface (not shown) and the back piece 134 has an inner surface 135. The inner surfaces of the front piece and back piece 132, 134 conform to an outer surface (e.g., outer surface 210) of the fixture 110. The inner surface of the front piece 132 may engage the front of the base component 170 and the inner surface 135 of the back piece 134 may engage the back of the base component 170 when the housing 130 is closed around the base component 170 disposed on the fixture 110. An actuator (not shown) may be used to open and close the housing 130. The housing 130 may include one or more heating elements to activate and/or cure the adhesive.

To form the seams 161, 162, the base component 170 is placed on the fixture 110. The base component 170 has first and second base joints 171, 172 shown as shoulder joints in a shirt body. The fixture 110 holds the base component 170 in its three dimensional (3-D) shape to hold the first and second base joints 171, 172 open. That is, the fixture 110 holds the first and second base joints 171, 172 in a substantially circular form such that the base joints 171, 172 have complimentary geometries that facilitates mating and joining with the tubular components 181, 182. Carriers 121, 122 are shown in an expanded position in FIG. 1A. As shown in the box in FIG. 1A, second carrier 122 in also shown in a retracted positon that is representative of first carrier 121. The first tubular component 181 and the second tubular component 182 are placed on the first and second carrier 121, 122, respectively in the retracted position. The carriers 121, 122 may include hooks, pins, vacuum ports or the like to temporarily secure the tubular components 181, 182 to the carriers 121, 122 until the tubular components 181, 182 are secured to the base component 170. Adhesive is applied to the tubular components 181, 182 and/or the joints 171, 172. The first carrier 121 and the first tubular component 181 are inserted into the open first base joint 171. The second carrier 122 and the second tubular component 182 are inserted into the open second base joint 172. In some embodiments, the housing 130 is closed to enclose the base component 170 placed on the fixture 110 after the tubular components 181, 182 are inserted into the base joints 171, 172. Extending the first carrier 121 presses the first tubular component 181 and the first base joint 171 against one another with the adhesive disposed therebetween to form the first seam 161. Extending the second carrier 122 presses the second tubular component 181 and the second joint 172 against one another with the adhesive disposed therebetween to form the second seam 162. The fixture 110, carriers 121, 122, and/or housing 130 may optionally be heated to cure and/or activate an adhesive applied to one of or both the base component 170 and the tubular components 181, 182 prior to assembly. The housing 130 is opened after the first and second tubular components 181, 182 (as shown in FIG. 1B) are adhered to the base component 170 to form the seams 161, 162. Once the seams 161, 162 are formed, the assembled garment 160 is removed from the fixture 100. While FIGS. 1A-1B illustrate the garment 160 as a t-shirt, garment 160 may be other articles of clothing, such as pants and jackets, among other garments.

Figure 2A:
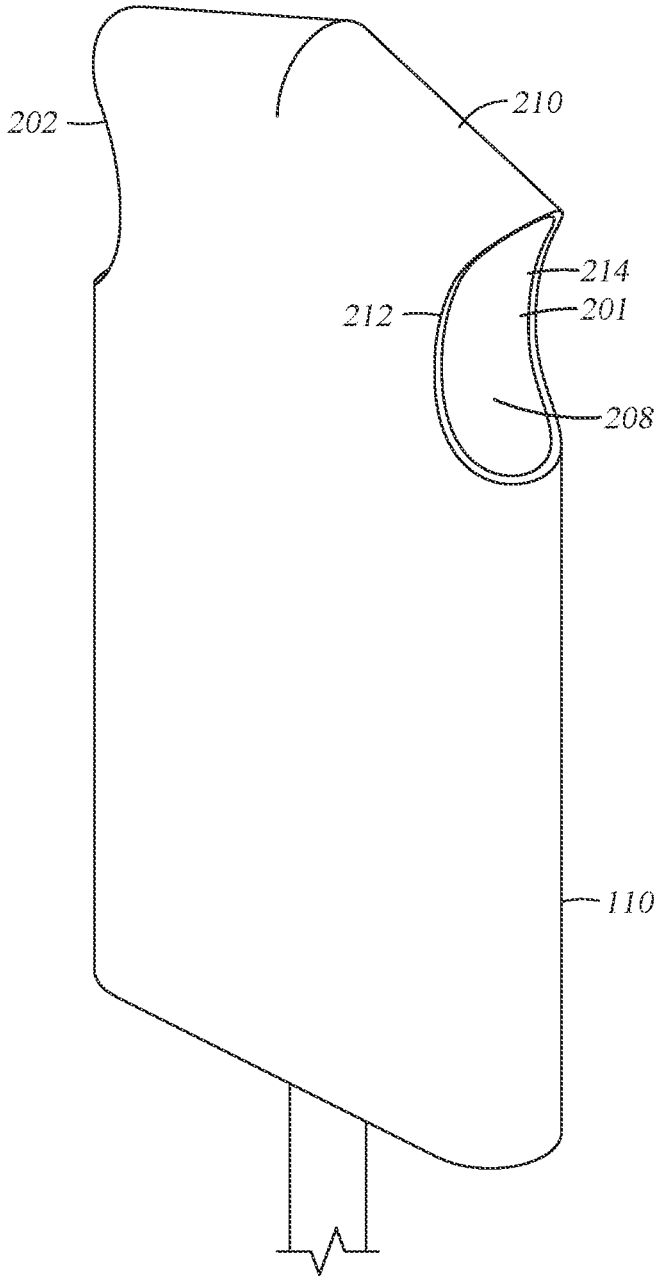
FIG. 2A is a perspective view of a fixture of the garment assembly system.
Figure 2B:
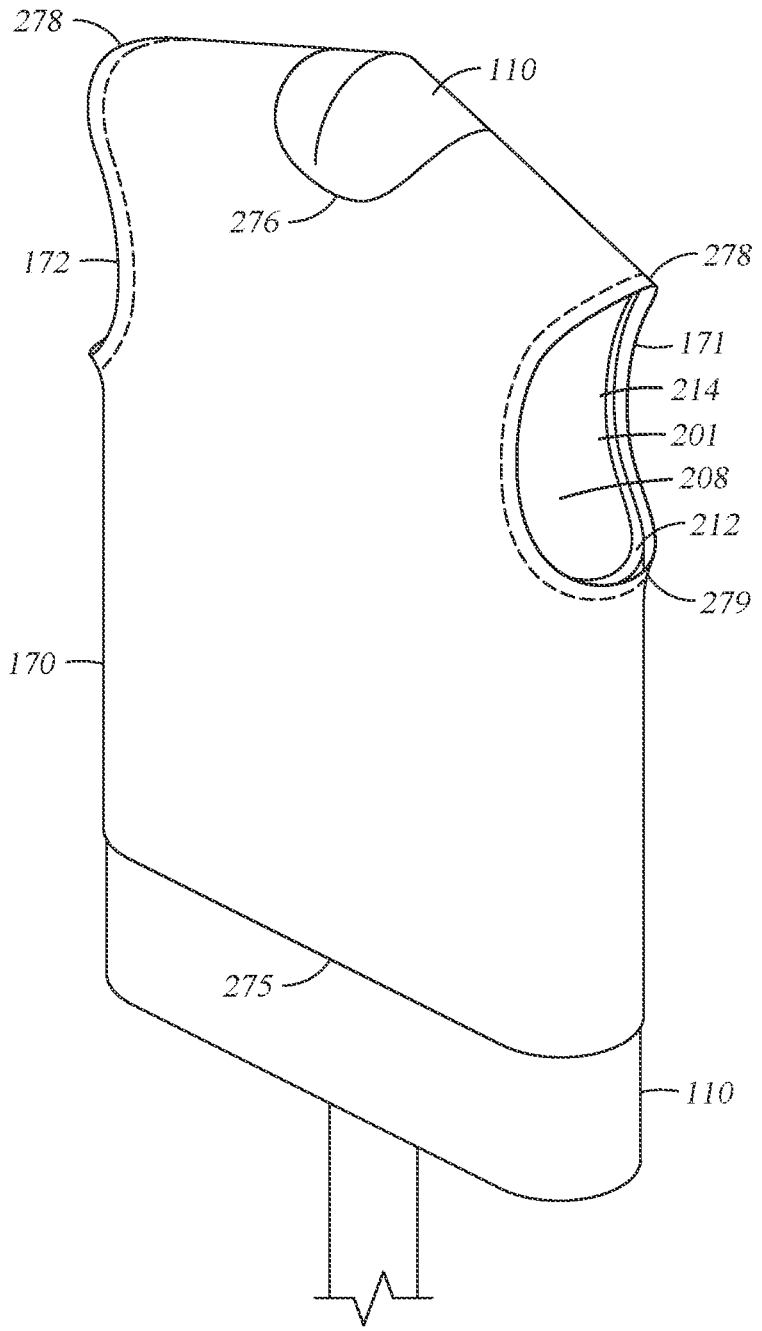
FIG. 2B is a perspective view of the fixture with a base component disposed thereon.

FIG. 2A illustrates the fixture 110 and FIG. 2B illustrates the base component 170 disposed on the fixture 110. The fixture 110 supports the base component 170 placed thereon during a garment assembly process. The fixture 110 includes a first opening 201, a second opening 202, and an outer surface 210. The first opening 201 receives the first carrier 121 and the second opening 202 receives the second carrier 122 when joining the tubular components 181, 182 to the base component 170. In some embodiments, a cavity 208 formed in the fixture 110 connects the first opening 201 and second opening 202. The fixture 110 may be made of a rigid material, such as a metal or hard plastic. In some embodiments, the cavity 208 of the fixture 110 is hollow, as shown in FIG. 2A. In some embodiments, the first opening 201 and the second opening 202 are depressions formed in the fixture 110 that are not connected to a cavity 208 within the fixture 110.

As shown in FIG. 2B, the base component 170 is made of a fabric and includes the first base joint 171, the second base joint 172, a torso opening 275, and a neck opening 276. Each base joint 171, 172 includes a base seam portion 278 around the edge of the base joint 171, 172. The base seam portion 278 is shown bounded by a dashed line around the each base joint 171, 172 in FIG. 2B. The base seam portion 278 includes a base seam surface 279 formed on the surface of the base component 170. The base seam surface 279 will overlap and contact the tubular component 180, 181 when assembling the tubular component 180, 181 to the respective base joint 171, 172. In some embodiments, adhesive is applied to the base seam surface 279 prior to contacting the seam surface 279 with a tubular component 181, 182. The base seam surface 279 may be on the inner surface of the base component 170 as shown in FIG. 2B, or the outer surface of the base component 170 as shown in FIG. 4B.

The base component 170 is fitted over and in contact with the outer surface 210 of the fixture 110. The torso opening 275 of the base component 170 is slipped over the fixture 110, such that the fixture 110 is positioned inside the base component 170. The outer surface 210 of the fixture 110 has a shape that substantially fills the base component 170 such that the base component 170 is maintained in a substantially wrinkle free, 3-D shape. The outer surface 210 keeps the first and second base joints 171, 172 at least partially open while the base component 170 is placed on the fixture 110. In some embodiments, the outer surface 210 has a shape that mirrors the contours of the base component 170, or a shape that mirrors a portion of a human body. In some embodiments, the fixture 110 is sized and shaped to slightly stretch the base component 170 as the base component 170 is placed on the fixture 110. The tension in the stretched base component 170 secures the base component 170 in a position on the fixture 110.

FIG. 2B shows the base component 170 disposed on the fixture 110. In FIG. 2B, the first base joint 171 is shown aligned with the first opening 201 and the second base joint 172 is aligned with the second opening 202. The first base joint 171 is open, which is representative of the second base joint 172. The carriers 121, 122 are inserted through the respective open joint 171, 172 and at least partially into the respective opening 201, 202

Figure 3A:
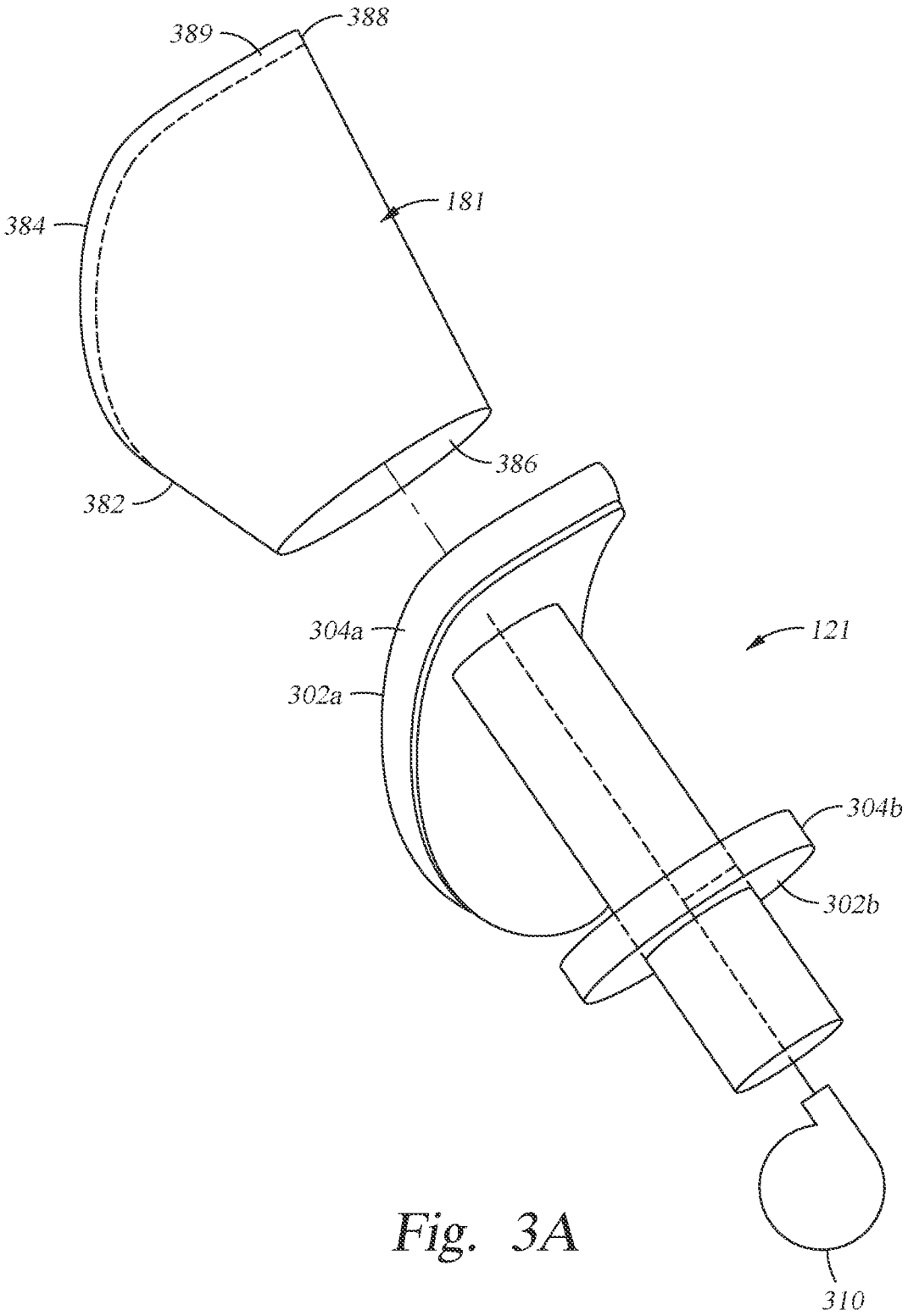
FIG. 3A illustrates a carrier of the garment assembly system and a tubular component of the garment.

The first and second openings 201, 202 include a profile 212 and an abutment surface 214. The profile 212 is the 3-D geometric shape of the openings 201, 202 which has a complimentary shape to the mating ends of the carriers 121, 122. The profile 212 generally sets the contour geometry of the base joint 171, 172. In some embodiments, the profile 212 is configured to position and/or orient the respective carriers 121, 122 to align the seam portion 278 of each base joint 171, 172 with a corresponding seam portion (e.g., tubular seam portion 388 as shown in FIG. 3A) of each tubular component 181, 182. In some embodiments, the profile 212 is configured to align the first and second tubular components 181, 182 to have a desired pitch (e.g., sleeve pitch) relative to the base component 170. For example, the profile 212 may guide the respective carrier 121, 122 to a position relative to the base joint 171, 172 as the carrier 121, 122 is extended.

The abutment surface 214 may be formed on the interior of the fixture 110 adjacent the respective opening 201, 202. The profile 212 may include the abutment surface 214. Extending the first carrier 121 presses the first tubular component 181, the adhesive, and the first base joint 171 together between the first carrier 121 and the abutment surface 214 of the first opening 201 to form the first seam 161. Extending the second carrier 122 presses the second tubular component 182, the adhesive, and the second base joint 172 together between the second carrier 122 and the abutment surface 214 of the second opening 201 to form the second seam 162. The abutment surface 214 may have a shape complementary to the shape of the respective carrier 121, 122 in the extended position. For example, the abutment surface 214 may be shaped such that the force applied by the carrier 121, 122 to press the respective joint 171, 172 and tubular component 181, 182 together is substantially perpendicular to the abutment surface 214.

Figure 3B:
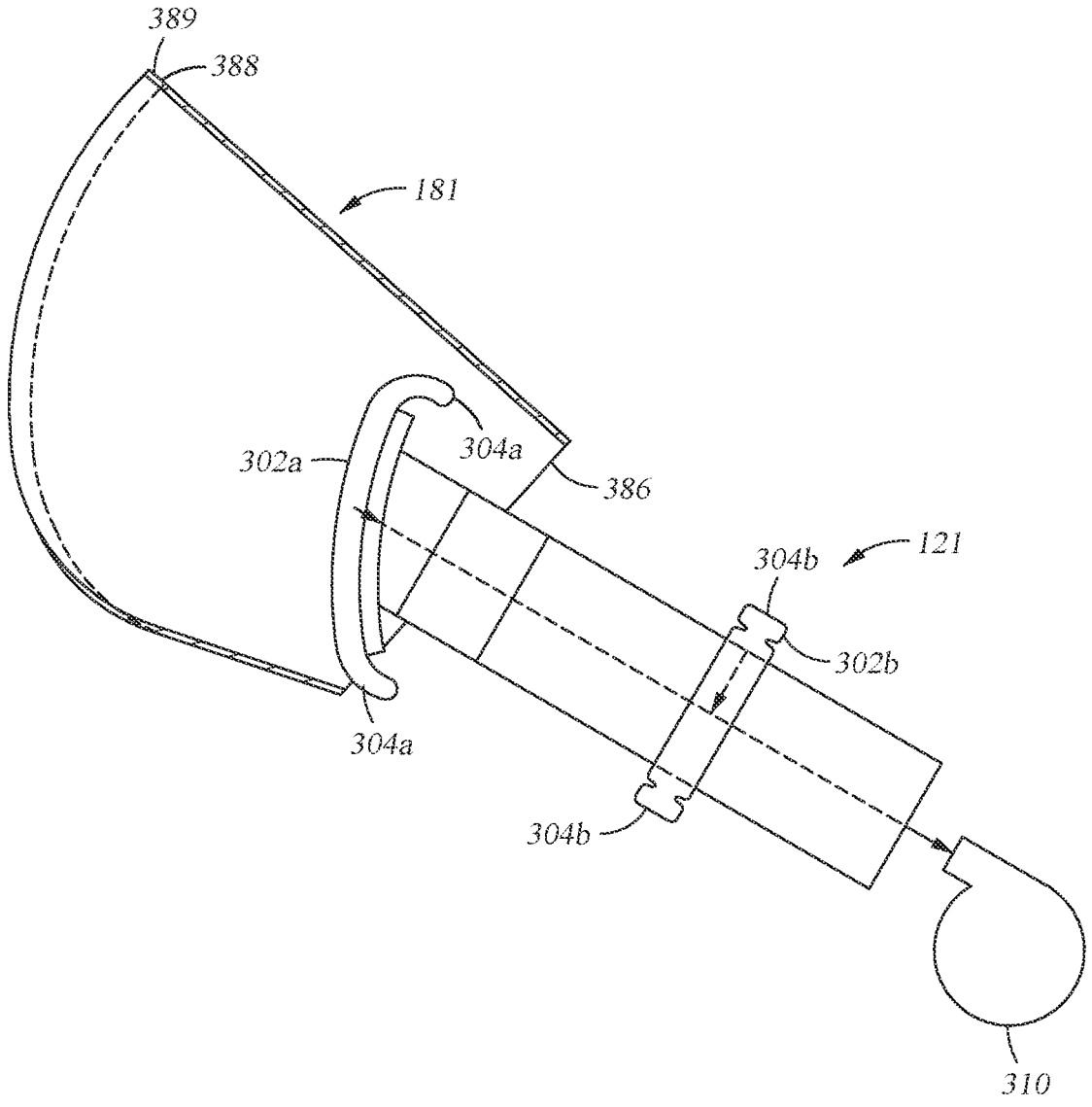
FIG. 3B is a cross-sectional view of the carrier in a retracted position.
Figure 3C:
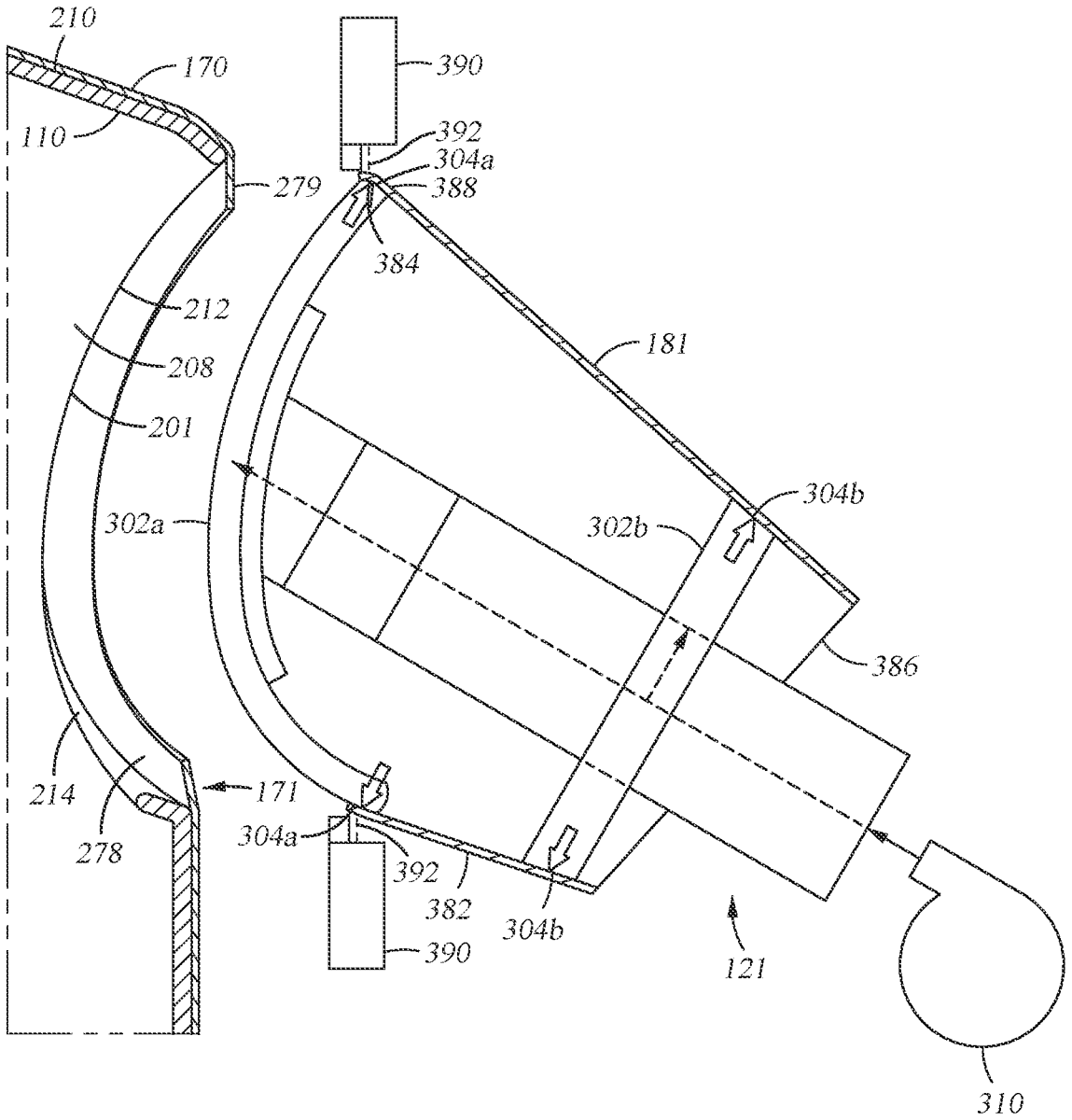
FIG. 3C is a cross-sectional view of the garment assembly system showing the carrier in an extended position.

FIGS. 3A-3C illustrate the first carrier 121 and the first tubular component 181. The first carrier 121 is representative of the second carrier 122 and the first tubular component 181 is representative of the second tubular component 182. FIG. 3A is a perspective view of the first tubular component 181 and the first carrier 121 prior to slipping the first tubular component 181 over the first carrier 121. FIG. 3B is a cross-sectional view of the first carrier 121 in a retracted (i.e., collapsed) position being inserted into the inside of the first tubular component 181. In the retracted position, the first tubular component 181 may be easily slipped onto and off of the first carrier 121. FIG. 3C is a cross-sectional view of the first carrier 121 in an extended position disposed inside of the first tubular component 181. In the extended position, the first carrier 121 snuggly engages the inner surface of the first tubular component 181, thus securing the first tubular component 181 to the first carrier 121.

The first and second tubular components 181, 182 are made of a fabric. As shown in FIG. 3A, the first and second tubular components 181, 182 each include a tubular body 382, a joint 384, an end opening 386. The joint 384 and the end opening 386 define the opposite ends of the tubular body 382. As shown, the joint 384 is an armhole that is configured to mate with a respective base joint 171, 172 (e.g., shoulder joint) of the base component 170. Each carrier 121, 122 holds the joint 384 of the respective tubular component 181, 182 at least partially open. That is, each carrier 121, 122 holds the joint 384 in a substantially circular form such that the joint 384 has a complimentary geometry to the base joints 171, 172 that facilitates mating and joining each joint 384 of the tubular components 181, 182 with a respective base joint 171, 172. The at least partially open joint 384 is engaged with the at least partially open base joint 171, 172 to form the respective seam 161, 162. To place the tubular components 181, 182 on the respective carrier 121, 122, the respective carrier 121, 122 in the retracted position is inserted through either the joint 384 or end opening 386. The carrier 121 may protrude from the joint 384 and end opening 386 as shown in FIGS. 3B-3C. In some embodiments, the tubular body 382 has a sufficient length such that the carrier 121 does not extend from the end opening 386 when the first tubular component 181 is disposed on the carrier 121. Once the tubular components 181, 182 are disposed on their respective carrier 121, 122, the carriers 121, 122 are extended to engage the interior surface of the tubular components 181, 182, thus securing the tubular components 181, 182 to the carriers 121, 122. The carriers 121, 122 are transformed between their extended and retracted states using any suitable mechanism and/or technique, some examples of which are provided further below.

Figure 3D:
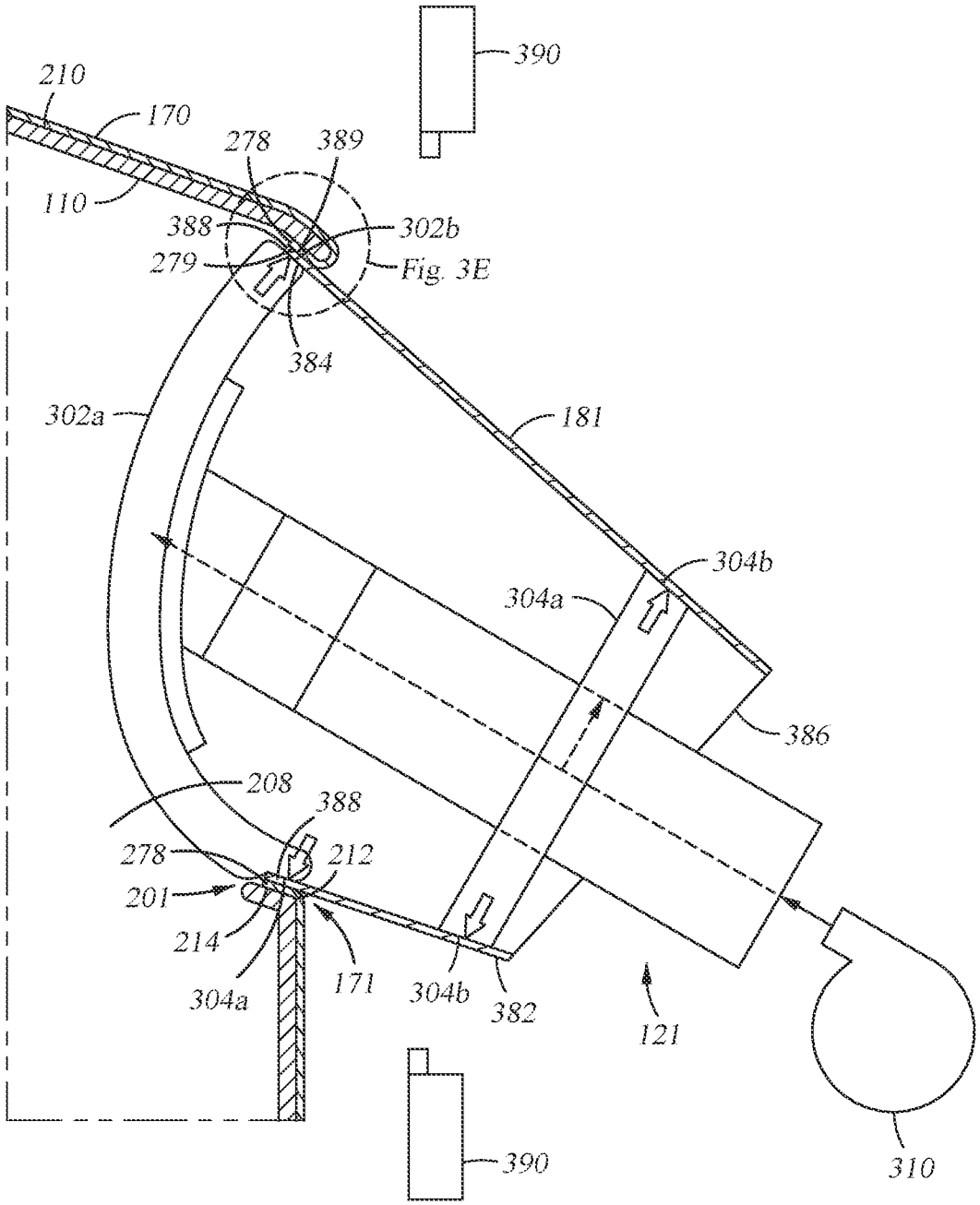
FIG. 3D illustrates a cross-section view of the garment assembly system showing the carrier and a tubular component disposed in a joint of a base component.

The joint 384 includes a tubular seam portion 388 defined around the edge of the joint 384 as shown by the dashed line. The tubular seam portion 388 includes a tubular seam surface 389 formed on the outer surface of the respective tubular component 181, 182. The tubular seam surface 389 contacts the base seam surface 278 when joining a tubular component 181, 182 with a respective base joint 171, 172. An adhesive dispenser 390 may deposit an adhesive 392 to one or both of the tubular seam surface 389 and the base seam surface 279. The adhesive 392 may be a heat activated adhesive. FIGS. 3C and 3D illustrate the adhesive dispenser 390 positioned to deposit the adhesive 392 on the tubular seam surface 389 prior to inserting the first tubular component 181 into the first base joint 171.

The first and second carriers 121, 122 are selectively moveable between the retracted position (e.g., FIG. 3B) to the extended position (e.g., FIG. 3D). The first carrier 121 and first tubular component 181 disposed thereon are insertable into the open first base joint 171 and into the first opening 201 while the first carrier 121 is in the retracted position. The second carrier 122 and second tubular component 182 disposed thereon are insertable into the open second base joint 172 and into the second opening 202 while the second carrier 122 is in the retracted position. Each carrier 121, 122, is moved to the extended position after being inserted into the respective base joint 171, 172 to engage the seam portion 388 of the tubular component 181, 182 with the seam portion 278 of a respective base joint 171, 172. In some embodiments, the carriers 121, 122 are moveable to a position between the retracted and the extended position after the respective tubular component 181, 182 is disposed thereon to facilitate gripping the tubular component 181, 182 during the insertion of the tubular component 181, 182 into the corresponding base joint 171, 172.

Each carrier 121, 122 may include at least one member 302 and an actuation assembly 310. The member 302 includes a surface 304. Each tubular component 181, 182 is placed onto the member 302 of the respective carrier 121, 122 in contact with the surface 304. FIGS. 3A-3C illustrate the member 302 as being a first bladder 302*a* and a second bladder 302*b* that are inflatable and deflatable by the actuation assembly 310. However, the member 302 may be an expandable member made of a semi-rigid material that is expandable by the actuation assembly 310 to move the carrier 121, 122 from the retracted position to the extended position, such as the carrier 420 shown in FIG. 4A. The semi-rigid material may be a plastic or other suitable material, such as a plastic or elastomer sheet, bladder or membrane. In one embodiment, the member 302 is an inflatable bladder (e.g., balloon) that substantially fills the interior of a tubular component 181, 182 when inflated by the actuation assembly 310. In some embodiments, the member 302 is one or more rigid or semi-rigid strips or plate moveable between the retracted and extended positions by the actuation assembly 310. The surface 304 may include mechanically securing elements, such as hooks or pins, to secure tubular component 181, 182 on the member 302 as the tubular component 181, 182 is inserted through the respective base joint 171, 172. Alternatively or in addition to the mechanically securing elements, the member 302 may include vacuum ports for securing the tubular component 181, 182 on the member 302.

The first bladder 302*a* is positioned adjacent to the tubular seam portion 388 upon insertion of the carrier 121, 122 into a respective tubular component 180, 181. As shown in FIG. 3C, the surface 304*a* of the first bladder 302*a* is engaged with the inner surface of the tubular seam portion 388 of the first tubular component 181 to hold the joint 384 open. The first bladder 302*a* may apply a force to the inner surface of the tubular seam portion 388 as shown by the block arrow in FIG. 3C as the first bladder 302*a* inflates. As shown in FIG. 3C, the surface 304*b* of the second bladder 302*b* is engaged with the inner surface of the first tubular component 181 adjacent the end opening 386. The second bladder 302*b* may apply a force to the inner surface of the first tubular component 181 adjacent the end opening 386 as shown by the block arrow in FIG. 3C as the second bladder 302*b* inflates. As shown in FIGS. 3B and 3C, the bladders 302*a*, 302*b* are expanded to move the first carrier 121 from the retracted position to the extended position. The bladders 302*a*, 302*b* may be inflatable by air or other fluid, such as nitrogen gas.

The actuation assembly 310 is actuated to move the respective carrier 121, 122 between the retracted position and the extended position. The actuation assembly 310 may be a pump or other pressurized gas source (for example, bottles or shop compressor) that inflates and deflates the bladders 302*a*, 302*b* as shown in FIGS. 3A-3D. The actuation assembly 310 may pump air, other gasses, or a fluid. The actuation assembly 310 may include a pump for each bladder 302*a*, 302*b*. The actuation assembly 310 is actuated to coordinate the expansion of the first and second bladders 302*a*, 302*b* to move the respective carrier 121, 122 between the retracted and the extended position. The bladders 302*a*, 302*b* may be independently movable. For example, the actuator assembly 310 coordinates the expansion and retraction of the bladders 302*a*, 302*b* against the first tubular component 181 to secure the first tubular component 181 to the first carrier 121. Actuating the actuation assembly 310 to inflate the bladders 302*a*, 302*b* extends the carrier 121 to press the joint 384 of one tubular component 180, 181 against a corresponding base joint 171, 172. For example, the actuation assembly 310 may inflate the bladders 302*a*, 302*b* by pumping air into each bladder 302*a*, 302*b*. The actuation assembly may draw a vacuum to deflate each bladder 302*a*, 302*b*. In some embodiments, the actuation assembly 310 moves the member 302 until movement is restricted by the profile 212 and/or abutment surface 214 of the opening 201, 202.

In some embodiments, the carriers 121, 122 includes an attachment point (not shown), such as a bracket, hook, hitch, or openings to receive a pin. A robotic arm may be connected to each carrier 121, 122 at the attachment point to facilitate automated movement of the carrier 121, 122 during the seam forming process. The carrier 121, 122 may also have a handle (not shown) to facilitate manual insertion of the carrier 121, 122 through the base joints 171, 172.

The garment 160 is formed by joining the joint 384 of each tubular component 181, 182 to a respective joint 171, 172 of the base component 170 with the adhesive 392 to form the seams 161, 162. The adhesive 392 is applied to the surface 279 of the base seam portion 278 and/or the surface 389 of the tubular seam portion 388 before inserting the tubular component 180, 181 into the respective base joint 171, 172. The first seam 161 is formed by adhering the tubular seam portion 388 of the first tubular component 181 to the base seam portion 278 of the first base joint 171 with the adhesive 392. The second seam 162 is formed by adhering the tubular seam portion 388 of the second tubular component 182 to the base seam portion 278 of the second base joint 172 with the adhesive 392.

To join the first tubular component 181 to the first base joint 171, the first tubular component 181 is placed on the first carrier 121 in the retracted position as shown in FIG. 3B. As shown in FIG. 3B, the actuation assembly 310 is applying a vacuum to collapse each bladder 302*a*, 302*b* as shown by the arrows showing air flow toward the actuation assembly 310. The first carrier 121 may be extended by pumping air into each bladder 302*a*, 302*b* with the actuation assembly 310 as shown by the arrows emanating from the actuation assembly 310 to engage the tubular component 181, as shown in FIG. 3C, to facilitate inserting the first tubular component 181 through the open first base joint 171. As shown in FIG. 3C, the outer surface 210 of the fixture 110 holds the first base joint 171 partially open to facilitate the insertion of the first tubular component 181 into the first base joint 171. The first carrier 121 holds the joint 384 of the first tubular component open as shown in FIG. 3C. Adhesive 392 is applied to either the surface 279 of the base seam portion 278 or the surface 389 of the tubular seam portion 388 before the first carrier 121 and first tubular component 181 are inserted into the first base joint 171. For example, adhesive 392 may be applied by the adhesive dispenser 392 shown in FIG. 3C.

The first carrier 121 and the first tubular component 181 are inserted through the open first base joint 171 and into the first opening 201 as shown in FIG. 3D. The insertion of the first tubular component 181 by the first carrier 121 may bend the base seam portion 278 into the first opening 201 against the abutment surface 214 as shown in FIG. 3D. The first carrier 121 and the first tubular component 181 are positioned to align the surface 389 of the tubular seam portion 388 with the surface 279 of the base seam portion 278. The second tubular component 182 is inserted into and aligned with the second base joint 172 in a similar manner as the first tubular component 181 is inserted into and aligned with the first base joint 171.

The first carrier 121 is extended by the actuation assembly 310 to apply a force to compress the seam portion 388 of the first tubular component 181, the adhesive 392, and the seam portion 278 of the first base joint 171 against the abutment surface 214 adjacent to the first base joint 171 to form the first seam 161. The second carrier 122 is extended by the actuation assembly 310 to apply a force to compress the seam portion 388 of the second tubular component 182, the adhesive 392, and the seam portion 278 of the second base joint 172 against the abutment surface 214 adjacent to the second base joint 172 to form the second seam 162. The adhesive 392 may be cured and/or activated by heat transferred from the fixture 110, the carriers 121, 122, and the housing 130.

Figure 3E:
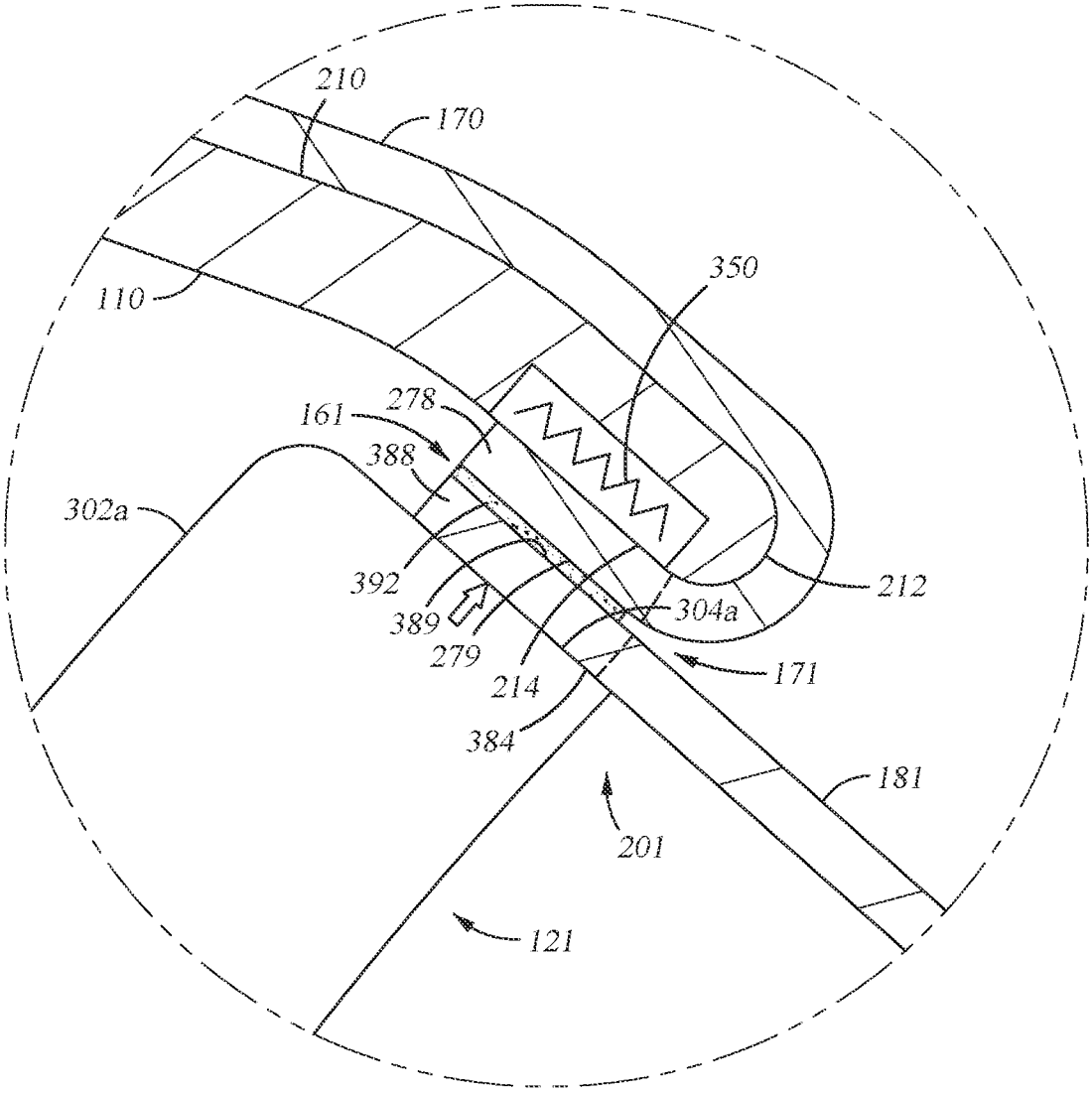
FIG. 3E illustrates the circled region in FIG. 3D.

FIG. 3D is a cross-sectional view of the garment assembly system 100 within the housing 130 in the closed position. FIG. 3E illustrates an enhanced view of the circled region to illustrate the base seam portion 278, the adhesive 392, and the tubular seam portion 388. The first carrier 121 is in the extended position disposed in the first joint 171. As shown, the base seam portion 278 of the first base joint 171 is engaged with the tubular seam portion 388 of the first tubular component 181 between the surface 304 of the first carrier 121 and the abutment surface 214 of the fixture 110. The base seam portion 278 is engaged with the abutment surface 214 and the tubular seam portion 388 is engaged with the surface 304*a* of the first bladder 302*a*. The adhesive 392 is disposed between the seam surfaces 279, 389. The adhesive 392 may penetrate the fabric of the seam portions 278, 388 as the two seam portions 278, 388 are pressed together. The expanded first bladder 302*a* applies a force, as represented by the block arrow in FIGS. 3D and 3E, to the member 302 that presses the base seam portion 278 and the tubular seam portion 388 together against the abutment surface 214. As shown, the abutment surface 214 formed by an angle complementary to the angle of the surface 304*a* in the extended position. The adhesive 392 forms the first seam 161 between the base seam portion 278 and the tubular seam portion 388. FIGS. 3D and 3E are illustrative of the engagement of the seam portion 278, 388 to form the second seam 162.

Heat may be applied to the adhesive 392 to activate and/or heat the adhesive 392. As shown in FIG. 3E, the fixture 110 may include one or more heating elements 350, such as a resistive heating element, in a wall to activate and/or cure the adhesive. In some embodiments, the carriers 121, 122 may include one or more heating elements or a hot air blower disposed therein to heat the adhesive 392. In some embodiments, the housing 130 may include one or more heating elements disposed therein to heat the adhesive 392. In some embodiments, the adhesive 392 is heated by other techniques, such as by flowing heat transfer fluid through conduits disposed on or in the fixture 110 and/or housing 130, via radiant heat lamps, via hot air, or other suitable technique. The adhesive may be activated and/or cured by transferring the assembled garment 160 to a heating station, such as an oven or hot press.

After the tubular components 181, 182 are joined to the base component 170 to form the garment 160, the housing 130 is returned to the open position. The carriers 121, 122 are returned to the retracted position. Once retracted, the carriers 121, 122 are withdrawn from the respective tubular components 181, 182. A person or robot, such as a robotic arm, then removes the garment 160 from the fixture 110. The garment 160 may be formed right-side out as shown in FIG. 3D with the joined seam portions 278, 388 disposed on the inside of the garment 160.

In some embodiments, the garment assembly system 100 does not include a housing 130. Each carrier is expanded to press the tubular seam portion of the tubular component against the base seam portion of the base component to place the adhesive in contact with both the base component and the tubular component to form a seam.

Figure 4A:
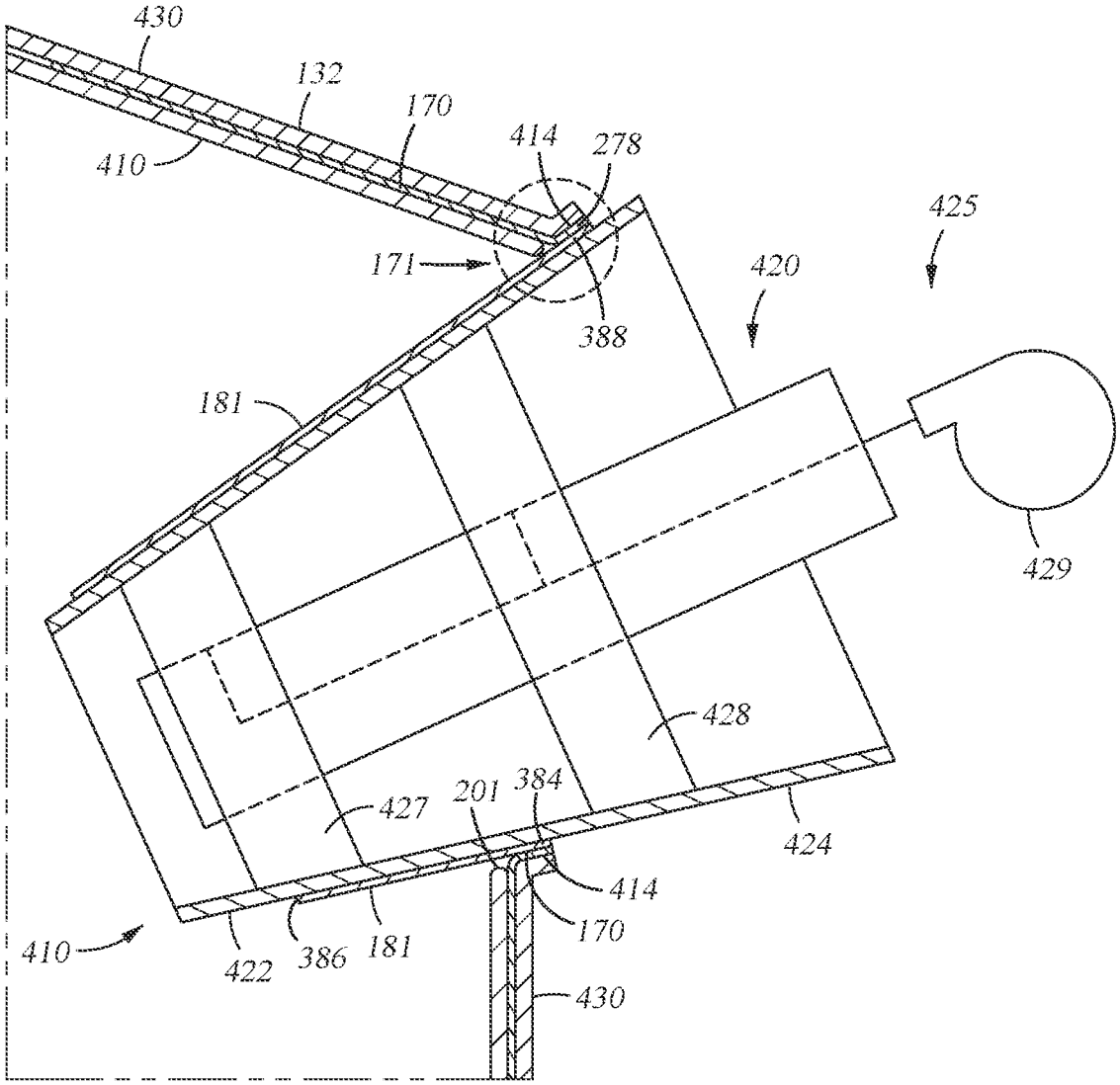
FIG. 4A illustrates a cross-section view of the garment assembly system showing the carrier and a tubular component disposed in a joint of a base component.
Figure 4B:
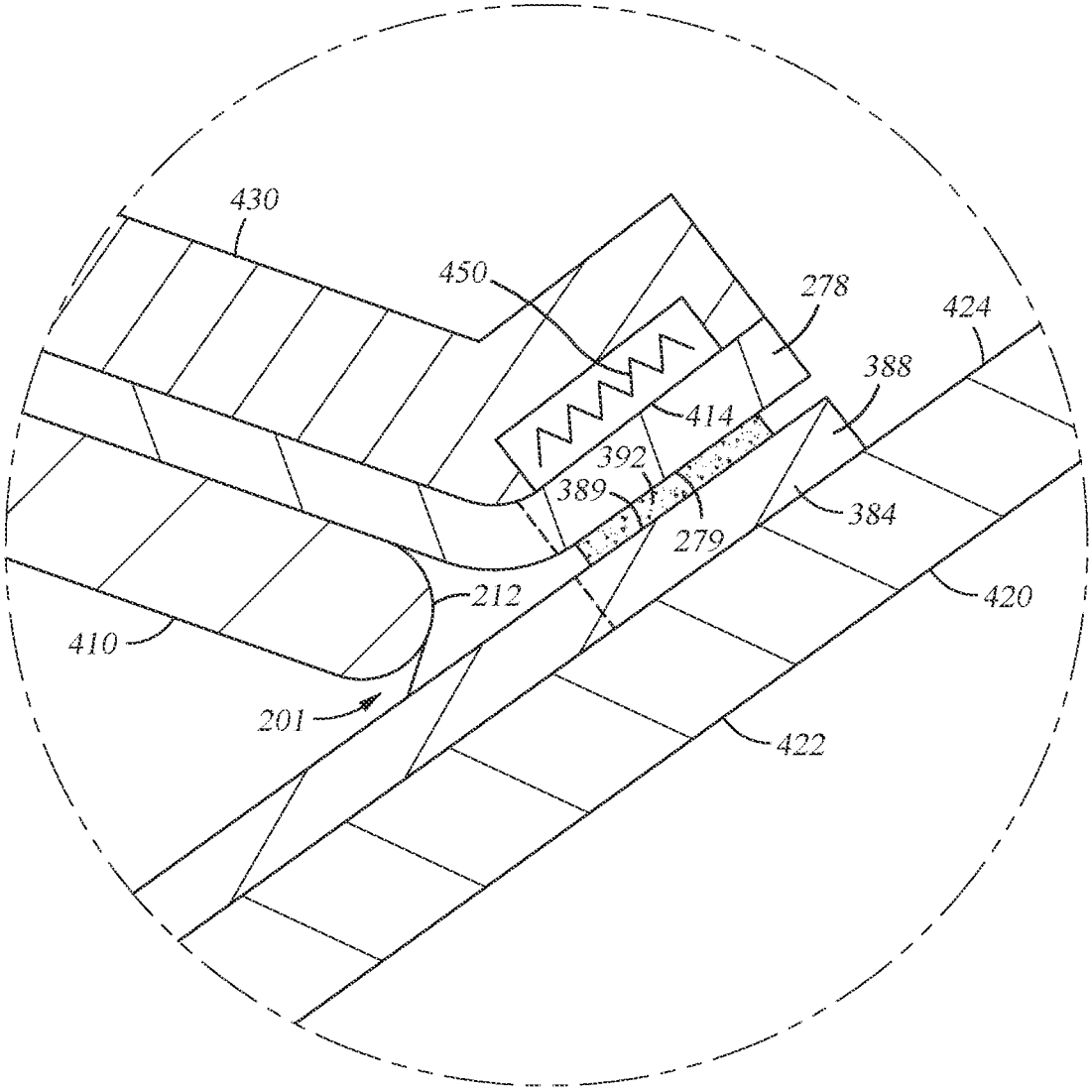
FIG. 4B illustrates the circled region in FIG. 4A.

FIG. 4A-4B illustrates a cross-sectional view of an alternative garment assembly 400 to assemble the garment 160. The alternative garment includes a fixture 410, at least one carrier 420, and a housing 430.

The fixture 410 has similar features as described above with respect to fixture 110. However, the fixture 410 does not include an abutment surface 214. The housing 430 includes similar features as described above with respect to housing 430, with the addition of an abutment surface 414 that is formed adjacent to each base joint 171, 172 upon closing the housing 430. The front piece and back piece of the housing 430 may have a portion of the abutment surface 414 formed thereon adjacent to the profile 133. The abutment surface 414 may have a shape complementary to the shape of the carrier 420 in the extended position. For example, the abutment surface 414 may be angled such that the force applied to the seam portions 278, 388 by the respective carrier 420 is substantially perpendicular to the abutment surface 414. After the first and second tubular components 180, 181 are inserted into the base component 170 on a carrier 420, the housing 430 is moved from the open to the closed position to position an abutment surface 414 adjacent to the first base joint 171 and the second base joint 172.

FIG. 4A illustrates a cross-section of an alternative carrier 420 for each tubular component 181, 182. As shown in FIG. 4A, the carrier 420 includes an expandable member 422 and an actuation assembly 425. In some embodiments, the member 422 may be substantially conical in shape or partially conical in shape as shown in FIG. 4A. However, the member 422 may be any suitable shape to support the tubular component 181, 182. The illustrated member 422 is made of a semi-rigid material that is expandable by the actuation assembly 425 to move the carrier 420 from the retracted position to the extended position. The semi-rigid material may be a plastic or other suitable material, such as a plastic or elastomer sheet, bladder or membrane. In some embodiments, the member 422 is one or more rigid or semi-rigid strips or plates moveable between the retracted and extended positions by the actuation assembly 425.

The actuation assembly 425 is actuated to move the respective carrier 420 between the retracted position and the extended position. The actuation assembly 425 may include one or more actuators such as a first actuator 427, a second actuator 428, and a pump 429 as shown in FIG. 4A. The first actuator 427 is shown positioned closer to the open end 386 than the second actuator 428, and the second actuator 428 is positioned closer to the joint 384 than the first actuator 427. The first actuator 427 and second actuator 428 are coordinated to move the respective carrier 420 between the radially retracted and the radially extended position. The actuators 427, 428 may be movable independently to control the diameter of each end of the carrier 420, and additionally, the angle of the surface 424 and/or the shape of the member 422. For example, the first actuator 427 and the second actuator 428 may be coordinated to expand the member 422 while maintaining the partially conical shape of the member 422 during expansion. Actuating the first actuator 427 and/or the second actuator 428 extends the carrier 420 to press the joint 384 of one tubular component 180, 181 against a corresponding base joint 171, 172.

As shown in FIG. 4A, the actuators 427 and 428 may be expandable bladders that are inflatable and deflatable by a pump 429. In some embodiments, the actuation assembly 425 may include a pump 429 for each actuator 427, 428. In some embodiments, the actuators 427, 428 may be a hydraulic, pneumatic, or electrical actuator. In some embodiments, the actuators 427, 428 may be linear solenoid actuators or ball-screw actuators and the pump 429 may be omitted. In some embodiments, the actuation assembly 425 includes only one actuator.

In some embodiments, the actuation assembly 425 may also include one or more rigid members (not shown) coupled to the actuators 427, 428 to facilitate the expansion of the member 422. The rigid members are moveable by the actuators 427, 428 to expand the member 422 to move the carrier 420 from the retracted to the extended position.

To form the garment 160, each tubular component 181, 182 is inserted through a respective open base joint 171, 172 on a separate carrier 420. Each tubular component 181, 182 may be placed on a carrier 420 by inserting the retracted carrier 420 into the tubular joint 384. The carrier 420 holds the joint 384 of each tubular component 181, 182 at least partially open during the insertion of the joint 384 into the respective base joint 171, 172. Adhesive 392 is applied to either the surface 279 of the base seam portion 278 or the surface 389 of the tubular seam portion 388 before the each tubular component 181, 182 is inserted through a respective open base joint 171, 172 on a carrier 420. The first tubular component 181 on a first carrier 420 is positioned to align the surface 389 of the tubular seam portion 388 with the surface 279 of the base seam portion 278. The second tubular component 182 on a second carrier 420 is aligned with the second base joint 172 in a similar manner as the first tubular component 181 is inserted into and aligned with the first base joint 171.

The actuation assembly 425 of each respective carrier 420 then extends the carrier 420 to press the tubular seam portion 388 and base seam portion 278 together between a surface 424 of the member 422 and the abutment surface 414. The adhesive 392 may penetrate the fabric of the seam portions 278, 388 as the two seam portions 278, 388 are pressed together. In some embodiments, the respective carrier 420 may press the tubular seam portion 388 and base seam portion 278 against the abutment surface 414 in the extended position. In some embodiments, each carrier 420 is moved to a further extended position to press the seam portions 278, 388 against the abutment surface 414.

FIG. 4A shows the housing 430 in the closed position and the first carrier 420 is in the extended position disposed in the first joint 171. FIG. 4B illustrates an enhanced view of the circled region to illustrate the base seam portion 278, the adhesive 392, and the tubular seam portion 388. The tubular seam portion 388 and base seam portion 278 are pressed together between a surface 424 of the member 422 and the abutment surface 414. The base seam portion 278 of the first base joint 171 is engaged with the tubular seam portion 388 of the first tubular component 181 between the surface 424 of the first carrier 121 and the abutment surface 414. The base seam portion 278 is engaged with the abutment surface 414 and the tubular seam portion 388 is engaged with the surface 424. As shown in FIG. 4B, the adhesive 392 is disposed between the seam surfaces 279, 389. The abutment surface 414 shown in FIGS. 4A and 4B is at an angle complementary to the angle of the surface 424 of the carrier 420 in the extended position. The adhesive 392 forms the first seam 161 between the base seam portion 278 and the tubular seam portion 388. FIG. 4B is illustrative of the engagement of the seam portion 278, 388 to form the second seam 162 using an additional carrier 420.

Heat may be applied to the adhesive 392 to activate and/or heat the adhesive 392. As shown in FIG. 4B, the housing 430 may include one or more heating elements 450, such as a resistive heating element, in a wall adjacent to the abutment surface 414 to activate and/or cure the adhesive. The heating elements 450 heat the adhesive 392 when the housing 430 is in the closed position to activate and/or cure the adhesive 392 to join the seam portions 278, 388 together. Alternatively or additionally, the fixture 440 and/or the carrier 420 may include one or more resistive heating elements to activate and/or cure the adhesive 392. The housing 430 may alternatively be heated by other techniques instead of heating elements 450, such as by flowing heat transfer fluid through conduits disposed on or in the housing 430, via radiant heat lamps, via hot air, or other suitable technique. In some embodiments, the adhesive 392 is not heated within the housing 430, and the garment 160 is instead transferred to a heating station, such as an oven or hot press, to activate or cure the glue after the garment 160 is removed from the garment assembly system 100.

In some embodiments, each carrier 420 is moved to the extended position within the base joint with the tubular component disposed thereon prior to closing the housing 430. Closing the housing 430 around the extended carrier 420 presses the seam portions 278, 388 together between the carrier 420 and abutment surface 414.

After the tubular components 181, 182 are joined to the base component 170 to form the garment 160, the housing 430 is returned to the open position. Each carrier 420 is returned to the retracted position. Once retracted, each carrier 420 is withdrawn from the respective tubular components 181, 182. A person or robot, such as a robotic arm, then removes the garment 160 from the fixture 110. If the garment 160 is formed inside-out, as shown in FIG. 4A-4B, then the garment 160 is turned right-sight out as shown in FIG. 1B to hide the joined seam portions 278, 388 on the inside of the garment 160.

In some embodiments, a tubular component in the form of a collar is joined to a shirt body with the garment assembly system 100. The garment assembly system 100 may include a third carrier similar to the carriers 121, 122, 420 as described above. The fixture, such as fixture 110 or 410, may include a third opening positioned between the first and second openings 201, 202 in the location of a neck joint of the shirt body. The fixture 110 holds the neck joint at least partially open. A third abutment surface for the collar may be formed in the fixture or in the housing. The collar is placed on the third carrier in a retraced position. An adhesive may be applied to either the neck joint or the collar joint, such as applying adhesive to the collar seam portion or the neck seam portion. The collar joint is held at least partially open by the third carrier. The collar is inserted into the at least partially open neck joint and the housing 130 is closed. The third carrier is extended to press the collar joint and the neck joint against the third abutment surface. In some embodiments, the adhesive is activated and/or cured by heat transferred from the carrier, the fixture, and/or the housing. The collar and sleeves may be joined with the shirt body at the same time.

In some embodiments, the tubular component is sized such that the tubular component is not inserted into an opening in the fixture 110 upon the insertion of the tubular component into the base joint. For example, a collar may have a length that does not extend into the neck opening in the fixture.

In one example, the base component is a shirt body and the tubular components are sleeves and/or a collar. In another example, the base component is the pelvic portion of a pair of pants and the tubular components are pant legs.

The number of tubular components, the number of carriers, and the number of openings in the fixture may match the number of joints in the base component. In some embodiments, the base component may include three joints, such as a joint for a first sleeve, a second sleeve, and a collar. In some embodiments, the base component only has a joint for a single tubular member.

In some embodiments, the carrier includes one or more inflatable bladders (e.g., balloons). In some embodiments, the carrier is a single inflatable bladder to engage the tubular garment that is substantially tubular in shape. In some embodiments, the carrier is a single inflatable bladder that has a shape that mirrors the internal shape of the tubular garment when in the extended position.

In one embodiment, the carrier is a single inflatable bladder that is inserted into the tubular garment in a collapsed (e.g., retracted) position. The single inflatable bladder is then inflated in the tubular component to substantially fill the interior volume of the tubular component. The inflation of the single bladder presses joint of the tubular component against the base joint of the base component to form a seam with the adhesive disposed between the tubular joint and the base joint.

In some embodiments of the carrier including a bladder (e.g., balloon), the bladder is substantially flat and/or slack in the collapsed (e.g., retracted) position. In some embodiments of the carrier including a bladder (e.g., balloon), the bladder has a shape and/or some rigidity in the collapsed (e.g., retracted) position sufficient to hold open the joint of the tubular component during the insertion of the joint of the tubular component into the base joint of the base component.

Figure 5:
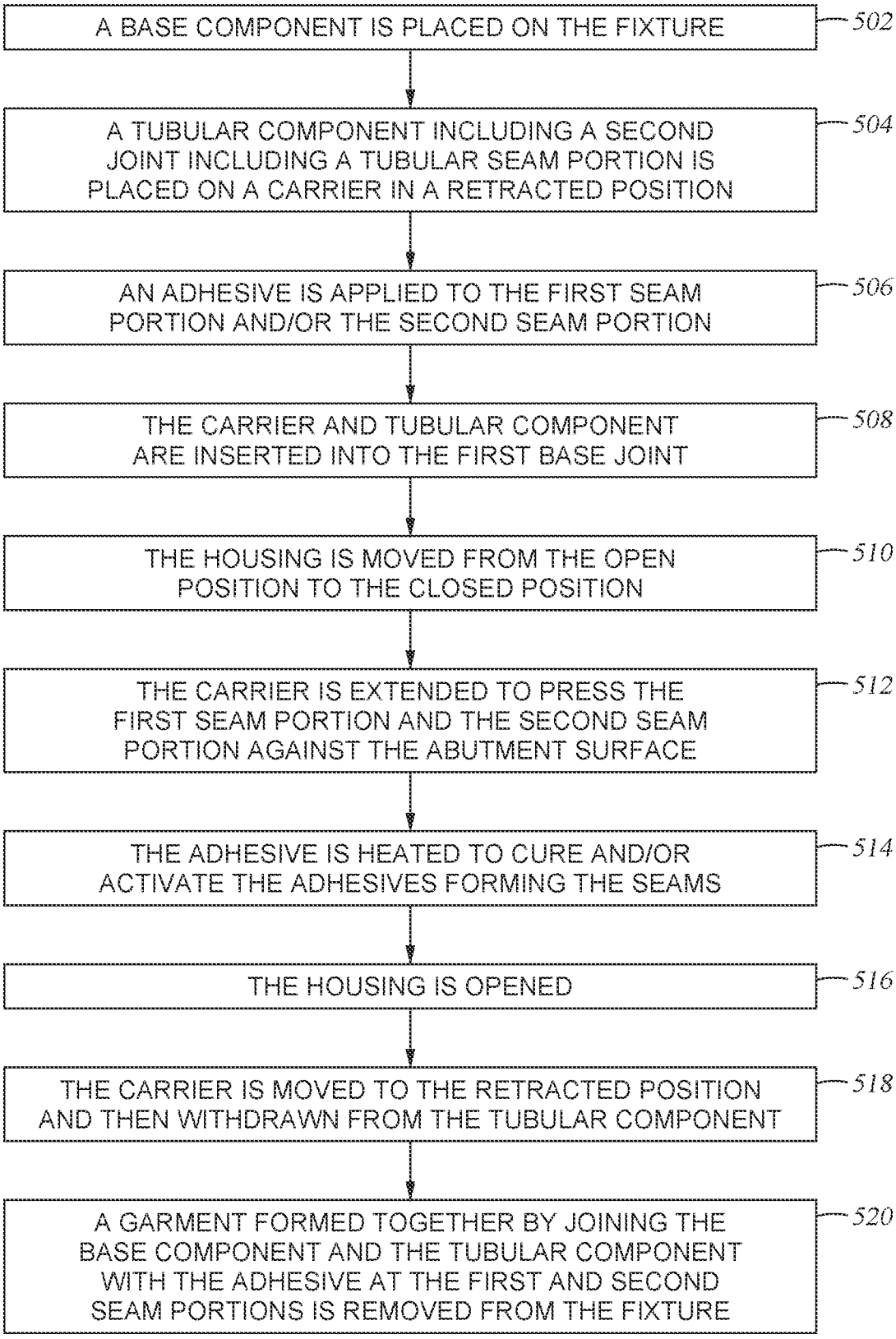
FIG. 5 is a flowchart of a method for joining a tubular component with a base component to form a garment.

FIG. 5 is a flowchart of a method of 500 forming a garment with the garment assembly system 100 or 400 according to one embodiment. The garment may be a shirt, jacket, dress, pants, or other garment with a tubular component. The method 500 may be an automated assembly process controlled by one or more controllers that control the garment assembly system 100, 400 to complete operation of the method 500. The automated assembly process may include one or more robots to complete the operations in response to one or more instructions from the controller. For example, a robotic arm connected to the attachment point at the end of each carrier 121, 122 to move the carriers 121, 122 relative to the fixture 110.

The method may begin at operation 502, where a base component is placed on the fixture. The base component 170 includes a first base joint with a base seam portion, such as one of the base joints 171, 172. The fixture holds the base component in its three dimensional (3-D) shape to hold the first base joint at least partially open.

At operation 504, a tubular component including a second joint including a tubular seam portion is placed on a carrier in a retracted position. The carrier holds the second joint at least partially open. Operation 504 may occur prior to operation 502.

At operation 506, an adhesive is applied to the first seam portion and/or the second seam portion. Operation 506 may occur prior to one or both operations 502 and 504. A person or a robot may apply the adhesive to the garment component. For example, an adhesive dispenser mounted on a robotic arm may apply the adhesive. In another example, the base and/or tubular components 170, 181, 182 may be moved on their respective fixture or carriers below an adhesive dispenser to apply the adhesive to the garment component.

At operation 508, the carrier and tubular component are inserted into the open first base joint. The carrier and tubular component may be received in an opening in the fixture upon insertion into the first base joint. The carrier may be positioned to align the tubular seam portion of the open second joint with the base seam portion of the open first base joint after or during the insertion of the carrier and tubular component into the first base joint.

At operation 510, the housing is moved from the open position to the closed position. In some embodiments, operation 510 includes moving the housing from an open position to a closed position to position the abutment surface formed on the housing adjacent to the first seam portion. The abutment surface on the housing may contact the first seam portion when the abutment surface is positioned adjacent to the first seam portion. Operation 510 may be omitted if a housing is not included in assembling the garment.

At operation 512, the carrier is extended to press the first seam portion and the second seam portion against the abutment surface. As the seam portions are pressed together, in one example the adhesive tacks the garment components together such that they may be later permanently secured using heat activation or curing either on the garment assembly system 100, 400 or at a location remote from the garment assembly system 100, 400.

At operation 514, the adhesive is heated to cure and/or activate the adhesives forming the seams. In one example, the adhesive is heated by one or more heating elements disposed in the housing, the carrier, and/or the fixture. In some embodiments, operation 514 is omitted or performed at a later stage of the assembly process and optionally at a location remote from the garment assembly system 100, 400.

At operation 516, the housing 130 is opened. Opening the housing may disengage the abutment surface from the first seam portion. Operation 516 may be omitted if housing is not included in assembling the garment.

At operation 518, the carrier is moved to the retracted position and then withdrawn from the tubular component. Operation 518 may occur prior to operation 516.

Operations 502 to 518 are optionally repeated as needed to add an additional tubular component(s) to the base component. In some embodiments, multiple tubular components are joined to the base component with the garment assembly system 100 or garment assembly system 400 simultaneously, sequentially, or by a combination thereof.

At operation 520, a garment formed together by joining the base component and the tubular component with the adhesive at the first and second seam portions is removed from the fixture. A person or a robot may remove the garment from the fixture.

Figure 6A:
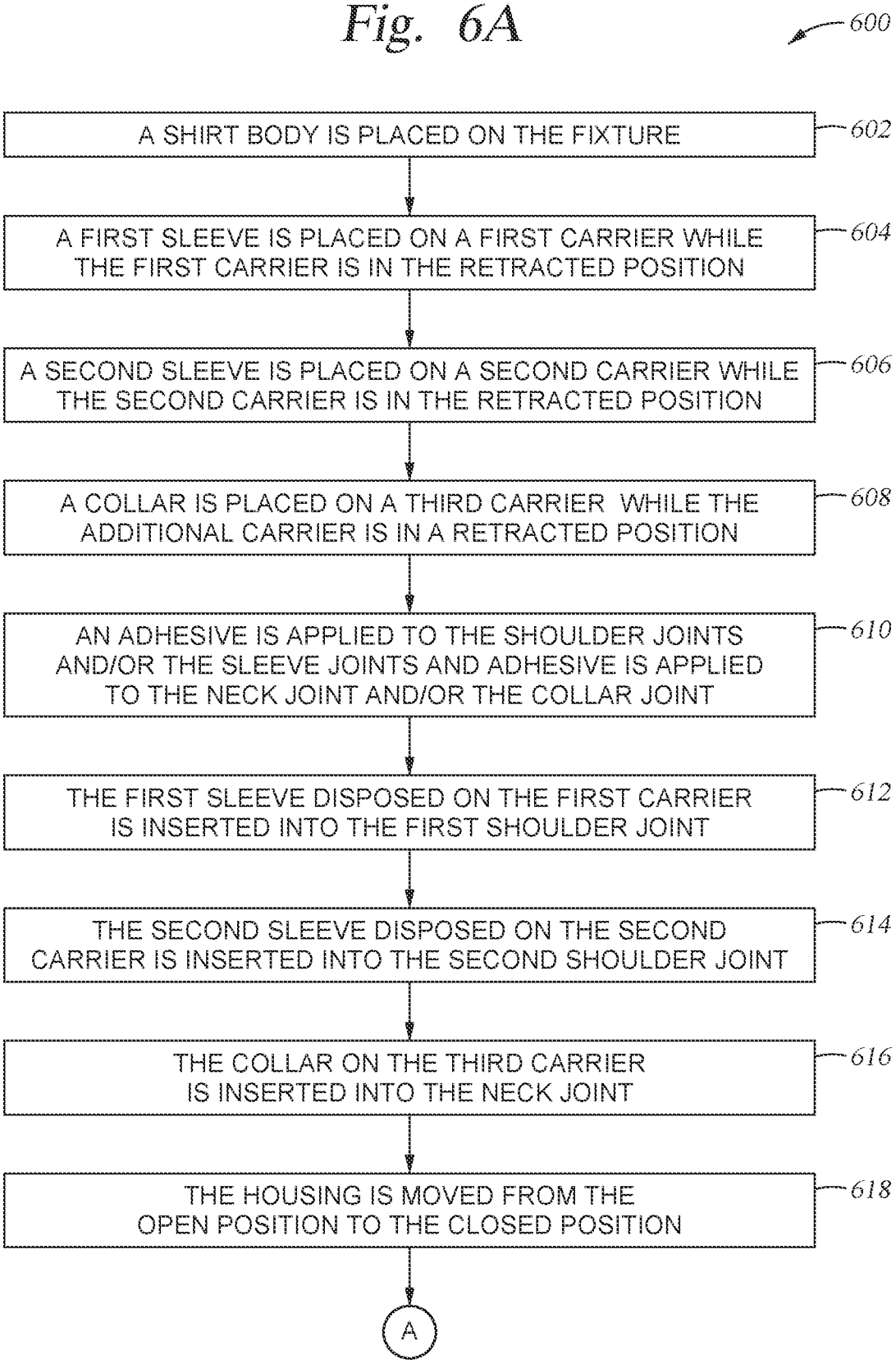
FIGS. 6A-6B are a flowchart of a method for forming a shirt.
Figure 6B:
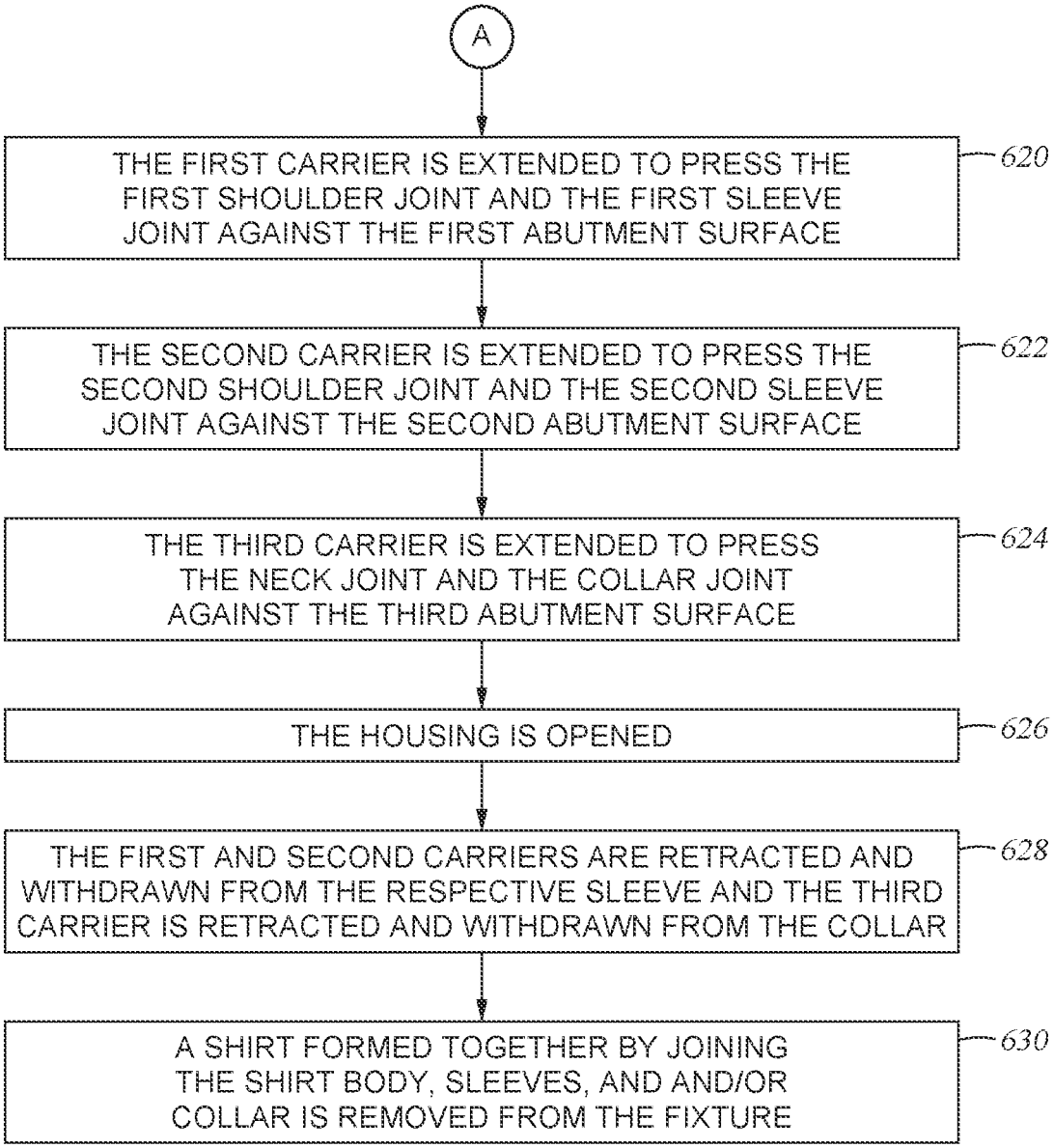

FIGS. 6A-6B are a flowchart of a method of 600 forming a shirt with the garment assembly system 100 or garment assembly system 400 according to one embodiment. The method 600 may be an automated assembly process controlled by one or more controllers that control the garment assembly system 100, 400 to complete operation of the method 600. The automated assembly process may include one or more robots to complete the operations in response to one or more instructions from the controller. For example, a robotic arm connected to the attachment point at an end of each carrier to move the carriers relative to the fixture.

At operation 602, a shirt body is placed on the fixture. The base component includes a first joint shoulder joint and a second shoulder joint. In some embodiments, the shirt body may include a neck joint for a collar. For example, the first shoulder joint may be the first base joint 171 and the second shoulder joint may be the second base joint 172. The fixture holds the base component in its three dimensional (3-D) shape to hold the first shoulder joint, the second shoulder joint, and the optional neck joint at least partially open.

At operation 604, a first sleeve is placed on a first carrier while the first carrier is in the retracted position. The first sleeve includes a first sleeve joint, such as joint 384. The first carrier holds the first sleeve joint at least partially open. Operation 604 may occur prior to or simultaneously with operation 602.

At operation 606, a second sleeve is placed on a second carrier while the second carrier is in the retracted position. The second sleeve includes a second sleeve joint, such as joint 384. The second carrier holds the second sleeve joint at least partially open. Operation 606 may occur prior to or simultaneously with operations 602, 604.

At optional operation 608, a collar is placed on a third carrier while the additional carrier is in a retracted position. The collar includes a collar joint. The third carrier holds the collar joint at least partially open. Operation 608 may occur prior to or simultaneously with operations 602, 604, 606. Operation 608 may be omitted when a collar is not being attached to the shirt body.

At operation 610, an adhesive 392 is applied to the shoulder joints and/or the sleeve joints. If the shirt includes a collar, adhesive is applied to the neck joint and/or the collar joint.

At operation 612, the first sleeve disposed on the first carrier is inserted into the open first shoulder joint. The first carrier may be positioned to align the open first sleeve joint with the open first shoulder joint after or during the insertion.

At operation 614, the second sleeve disposed on the second carrier is inserted into the open second shoulder joint. Operation 614 may occur prior to or simultaneously with operation 612. The second carrier may be positioned to align the second sleeve joint with the second shoulder joint after or during the insertion.

At optional operation 616, the collar on the third carrier is inserted into the open neck joint. Operation 614 may occur prior to or simultaneously with operations 612, 614. The third carrier may be positioned to align the collar joint with the neck joint after or during the insertion. Operation 616 may be omitted if a collar is not being attached to a shirt body.

At operation 618, the housing may be moved from the open position to the closed position. Closing the housing may position an abutment surface adjacent to each shoulder joint and the neck joint. Operation 618 may be omitted if assembling the shirt does not include a housing.

At operation 620, the first carrier is extended to press the first shoulder joint and the first sleeve joint against the first abutment surface. The first abutment surface may be formed on the fixture or on a housing enclosing the shirt body.

At operation 622, the second carrier is extended to press the second shoulder joint and the second sleeve joint against the second abutment surface. The second abutment surface may be formed on the fixture or on a housing enclosing the shirt body. Operation 622 may occur prior to or simultaneously with operation 620.

At operation 624, the third carrier is extended to press the neck joint and the collar joint against the third abutment surface. The third abutment surface may be formed on the fixture or on a housing enclosing the shirt body. Operation 624 may occur prior to or simultaneously with operations 620, 622. Operation 624 may be omitted if a collar is not being attached to a shirt body.

At operation 626, the housing is opened. Operation 626 may be omitted if assembling the shirt does not include a housing.

At operation 628, the first and second carriers are retracted and withdrawn from the respective sleeve. The third carrier is retracted and withdrawn from the collar. Operation 628 may occur prior to operation 626.

At operation 630, a shirt formed together by joining the shirt body, sleeves, and and/or collar is removed from the fixture. The method 600 is repeatable to form additional shirts.

In one embodiment, a method of assembling a garment includes placing a base component with a first joint on a fixture to hold the first joint at least partially open, the first joint including a first seam portion. The method further includes placing a tubular component with a second joint on a carrier to hold the second joint at least partially open, the second joint including a second seam portion. The method further includes applying an adhesive to the first seam portion or the second seam portion, or both the first seam portion and the second seam portion. The method further includes mating the first seam portion and the second seam portion and placing the adhesive in contact with both the base component and the tubular component to form a seam.

In the current disclosure, reference is made to various embodiments. However, it should be understood that the present disclosure is not limited to specific described embodiments. Instead, any combination of the following features and elements, whether related to different embodiments or not, is contemplated to implement and practice the teachings provided herein. Additionally, when elements of the embodiments are described in the form of "at least one of A and B," it will be understood that embodiments including element A exclusively, including element B exclusively, and including element A and B are each contemplated. Furthermore, although some embodiments may achieve advantages over other possible solutions or over the prior art, whether or not a particular advantage is achieved by a given embodiment is not limiting of the present disclosure. Thus, the aspects, features, embodiments and advantages disclosed herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

As will be appreciated by one skilled in the art, embodiments described herein may be embodied as a system, method or computer program product. Accordingly, embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments described herein may take the form of a computer program product embodied in one or more computer readable medium(s) having computer readable program code embodied thereon.

Program code embodied on a computer readable medium may be transmitted using any appropriate medium, including but not limited to wireless, wireline, optical fiber cable, RF, etc., or any suitable combination of the foregoing.

Computer program code for carrying out operations for embodiments of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure are described herein with reference to flowchart illustrations or block diagrams of methods, apparatuses (systems), and computer program products according to embodiments of the present disclosure. It will be understood that each operation of the flowchart illustrations or block diagrams, and combinations of operations in the flowchart illustrations or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the operation(s) of the flowchart illustrations or block diagrams.

These computer program instructions may also be stored in a computer readable medium that can direct a computer, other programmable data processing apparatus, or other device to function in a particular manner, such that the instructions stored in the computer readable medium produce an article of manufacture including instructions which implement the function/act specified in the operation(s) of the flowchart illustrations or block diagrams.

The computer program instructions may also be loaded onto a computer, other programmable data processing apparatus, or other device to cause a series of operational steps to be performed on the computer, other programmable apparatus or other device to produce a computer implemented process such that the instructions which execute on the computer, other programmable data processing apparatus, or other device provide processes for implementing the functions/acts specified in the operation(s) of the flowchart illustrations or block diagrams.

The flowchart illustrations and block diagrams in the Figures illustrate the architecture, functionality, and operation of possible implementations of systems, methods, and computer program products according to various embodiments of the present disclosure. In this regard, each operation in the flowchart illustrations or block diagrams may represent a module, segment, or portion of code, which comprises one or more executable instructions for implementing the specified logical function(s). It should also be noted that, in some alternative implementations, the functions noted in the block may occur out of the order noted in the Figures. For example, two blocks shown in succession may, in fact, be executed substantially concurrently, or the blocks may sometimes be executed in the reverse order or out of order, depending upon the functionality involved. It will also be noted that each operation of the block diagrams or flowchart illustrations, and combinations of blocks in the block diagrams or flowchart illustrations, can be implemented by special purpose hardware-based systems that perform the specified functions or acts, or combinations of special purpose hardware and computer instructions.

While the foregoing is directed to embodiments of the present disclosure, other and further embodiments of the disclosure may be devised without departing from the basic scope thereof, and the scope thereof is determined by the claims that follow.

What is claimed is:

1. A method of assembling a garment, comprising:

placing a base component with a first joint on a fixture, the fixture maintaining a three-dimensional shape of the base component to hold the first joint at least partially open, the first joint including a first seam portion;

placing a tubular component with a second joint on a carrier, the second joint including a second seam portion;

applying an adhesive to the first seam portion or the second seam portion, or both the first seam portion and the second seam portion;

mating the first seam portion disposed on the fixture and the second seam portion disposed on the carrier and placing the adhesive in contact with both the base component and the tubular component to form a seam; and extending the carrier to mate the first seam portion and the second seam.

2. The method of claim 1, further comprising:

heating the adhesive forming the seam between the first seam portion and the second seam portion.

3. The method of claim 1, further comprising:

inserting the carrier and the tubular component into the first joint;

closing a housing to position an abutment surface adjacent to the first seam portion;

extending the carrier to press the first seam portion and the second seam portion together against the abutment surface to form the seam;

opening the housing;

moving the carrier from an extended position to a retracted position; and withdrawing the carrier from tubular component.

4. The method of claim 3, further comprising:

removing the base component and the tubular component from the fixture, wherein the base component and the tubular component that are connected together at a seam formed by the adhesive between the first seam portion and the second seam portion.

5. The method of claim 3, wherein the carrier is received in an opening in the fixture upon the insertion of the carrier into the first joint.

6. The method of claim 5, further comprising:

moving the carrier relative to the fixture within the opening to position the second seam portion of the tubular component adjacent to the first seam portion of the base component.

7. The method of claim 1, wherein extending the carrier engages the carrier with a profile of an opening in the fixture to align the second seam portion of the tubular component with the first seam portion of the base component.

8. The method of claim 7, wherein the tubular component is in contact with the profile upon engagement of the carrier with the profile.

9. The method of claim 1, further comprising extending the carrier to press the first seam portion and the second seam portion together against an abutment surface of the fixture to form the seam.

10. The method of claim 1, wherein the carrier includes an expandable member that is expanded as the carrier is extended.

11. The method of claim 1, wherein the tubular component is at least one of a sleeve, a pant leg, or a collar.

12. The method of claim 1, wherein the carrier includes at least one bladder that is selectively inflatable and deflatable.

13. A method of assembling a shirt, comprising:

disposing a shirt body on a fixture, wherein the shirt body includes a first shoulder joint and a second shoulder joint both the first shoulder joint and the second shoulder joint held at least partially open by the fixture;

placing a first sleeve on a first carrier, the first sleeve including a first sleeve joint held at least partially open by the first carrier;

placing a second sleeve on a second carrier, the second sleeve including a second sleeve joint held at least partially open by the second carrier;

inserting the open first sleeve joint of the first sleeve disposed on the first carrier into the open first shoulder joint, at least one or both of the first sleeve joint and the first shoulder joint having adhesive disposed thereon;

inserting the open second sleeve joint of the second sleeve disposed on the second carrier into the open second shoulder joint, at least one or both of the second sleeve joint and the second shoulder joint having adhesive disposed thereon;

pressing the open first shoulder joint and the open first sleeve joint together against a first abutment surface such that the adhesive forms a first seam;

pressing the open second shoulder joint and the open second sleeve joint together against a second abutment surface such that the adhesive forms a second seam;

placing a shirt collar on a third carrier, the shirt collar including a collar joint held at least partially open by the third carrier;

inserting the open collar joint of the shirt collar disposed on the third carrier into an open neck joint of the shirt body, at least one or both of the collar joint and the neck joint having adhesive disposed thereon; and pressing the open collar joint and the open neck joint against a third abutment surface such that the adhesive forms a third seam.

14. The method of claim 13, wherein the first carrier, second carrier, and third carrier include at least one bladder that is selectively inflatable and deflatable.

* * * * *